United States Patent [19]

Nelson et al.

[11] Patent Number: 4,715,841

[45] Date of Patent: Dec. 29, 1987

[54] BALLOON HOLDER

[75] Inventors: David C. Nelson; Michael J. Fresh, both of Copley, Ohio; Herbert Mueller, Herznach, Switzerland

[73] Assignee: Ballon-Mueller AG, Herznach, Switzerland

[21] Appl. No.: 838,516

[22] Filed: Mar. 11, 1986

[51] Int. Cl.[4] ..... A63H 3/06

[52] U.S. Cl. ..... 446/222; 446/220; 24/545

[58] Field of Search ..... 206/315.1; 24/545, 555; 446/222, 223

[56] References Cited

U.S. PATENT DOCUMENTS

| | | | |
|---|---|---|---|
| 1,543,954 | 6/1925 | Shira | 446/222 |
| 1,994,202 | 3/1935 | Sarsfield | 446/222 |
| 2,664,667 | 1/1954 | Burroughs | 446/222 |
| 2,840,948 | 7/1958 | Stickley | 446/223 |
| 3,267,604 | 8/1966 | Goldsmith | 446/222 |
| 3,324,853 | 6/1967 | Czorny et al. | 24/545 |
| 3,379,465 | 4/1968 | Raymond | 24/545 |
| 4,428,149 | 1/1984 | Brown | 446/222 |
| 4,566,660 | 1/1986 | Ansher et al. | 24/545 |
| 4,589,854 | 5/1986 | Smith | 446/223 |
| 4,661,081 | 4/1987 | Basseches | 446/222 |

FOREIGN PATENT DOCUMENTS

| | | | |
|---|---|---|---|
| 105179 | 4/1984 | European Pat. Off. | 446/222 |
| 414495 | 9/1910 | France | 446/223 |
| 1384510 | 11/1964 | France | 446/222 |
| 2093709 | 9/1982 | United Kingdom | 446/222 |

*Primary Examiner*—George E. Lowrance
*Assistant Examiner*—David T. Fidei
*Attorney, Agent, or Firm*—Oldham, Oldham & Weber Co.

[57] ABSTRACT

Balloon holder for toy balloons. The balloon holder of the invention has a cup and a stem. The latter for insertion into one end of a hollow balloon stick. The stem is of such shape that the neck of the balloon is completely concealed between the stem and the balloon stick. The preferred stem is generally cylindrical with an interior channel and an exterior cutaway portion for downwardly extending an upwardly extending portions, respectively of the neck. A vertical slit in the cup permits rapid insertion of a balloon neck into the balloon holder.

13 Claims, 10 Drawing Figures

BALLOON HOLDER

CROSS REFERENCE TO RELATED APPLICATIONS

Reference is made to pending Swiss patent application No. 4413/85, filed Oct. 14, 1985, and to pending European patent application No. 86810013.2 filed Jan. 15, 1986. Herbert Mueller, one of the co-inventors herein, is the inventor named in both of the above applications. The Swiss and European applications show and describe a balloon holder having a cup and a hollow stem into which a balloon stick is inserted. The balloon holder therein has a longitudinal slit extending from a top to bottom for insertion of a balloon tail and a notch for anchoring the balloon tail. However, the balloon holder of the Swiss and European applications differs from the balloon holder herein in other respects.

TECHNICAL FIELD

This invention relates to balloon holders and more particularly to balloon holders of the type comprising a cup for receiving a balloon and a stem for receiving a balloon stick.

BACKGROUND ART

Large numbers of inflatable toy balloons are sold or giving away as novelty items each year. Toy balloons are of two general types, those made of latex, and those made of a non-elastomeric polymer film, usually polyethylene terphthalate ("Mylar"). Latex balloons are stretchable, typically have a short neck surrounding the inflation opening, and may be sold either collapsed or inflated. When sold in inflated form, they may be tied to a stick; usually they are tied directly to a stick without the aid of a holder. "Mylar" balloons are non-stretchable, typically are metallized to give a silvery appearance, have a long neck typically about four inches (10 cm) long, and are usually distributed in inflated form secured to a stick by means of a balloon holder.

Balloon holders currently in use are of various designs, but invariably such a balloon holder comprises a funnel-shaped cup for receiving the balloon itself, and a stem for receiving the balloon stick. The cup typically has one or more cutouts (e.g. holes or slots) for engaging the neck to secure the balloon to the cup; the neck is wound around the outside of the cup and is secured near its ends to one or two of these holes or slots. The stem is generally a hollow cylinder or tube, closed at its upper end and open at its lower end. One end of the balloon stick is inserted into the open end of the tube.

Known balloon holders have several disadvantages. First, this type of balloon holder does not center the balloon. Because the holes or slots are off center, the balloon is also off center when secured to the holder, secured to the holder, and the balloon is not always at the same angle. Also, as a consequence of being off center, the balloon is not firmly secured to the holder, which could allow the balloon to slip out of the holes or slots and escape. Another disadvantage of present balloon holders is poor esthetics. The balloon neck is visible on the outside of the cup, and the free end of the neck usually sticks out, i.e. away from the cup.

DISCLOSURE OF THE INVENTION

An object of this invention is to center a balloon over the balloon holder.

Another object of this invention is to fasten the balloon securely to the holder.

Still another object of this invention is to conceal the neck of the balloon when it is secured to the holder.

These and other objects of the invention will be apparent from the description which follows.

According to the present invention, there is provided a one piece balloon holder or balloon holding device comprising a cup and a stem extending longitudinally therefrom, in which the cup has an opening for insertion of the neck of a balloon and in which the stem is adapted to be inserted into one end of a hollow balloon stick, is shaped so as to provide space for concealing the balloon neck between the stem and the stick, and has means for firmly clasping the balloon neck.

BEST MODE FOR CARRYING OUT INVENTION

Figure 2:
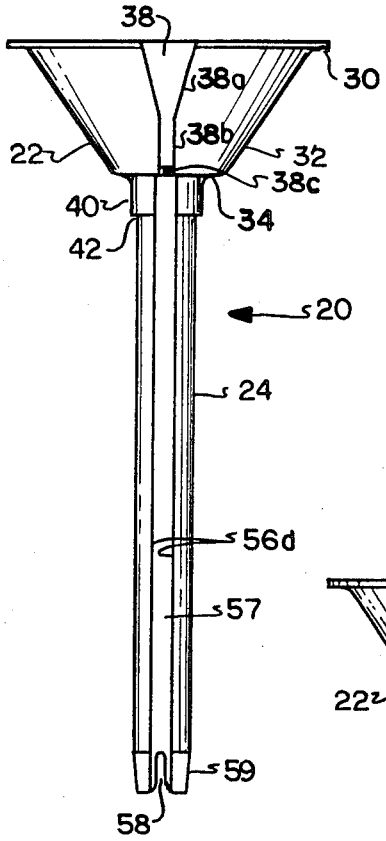
FIG. 2 is a back elevational view of the balloon holding device shown in FIG. 1.
Figure 4:
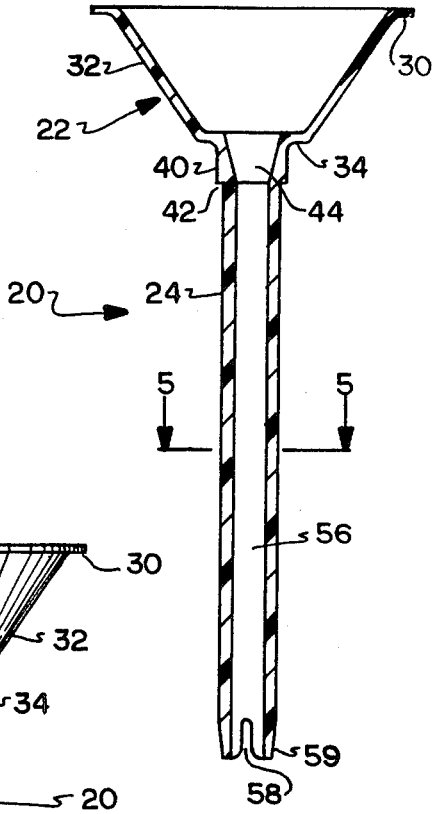
FIG. 4 is a vertical sectional view taken along line 4—4 of FIG. 3.
Figure 1:
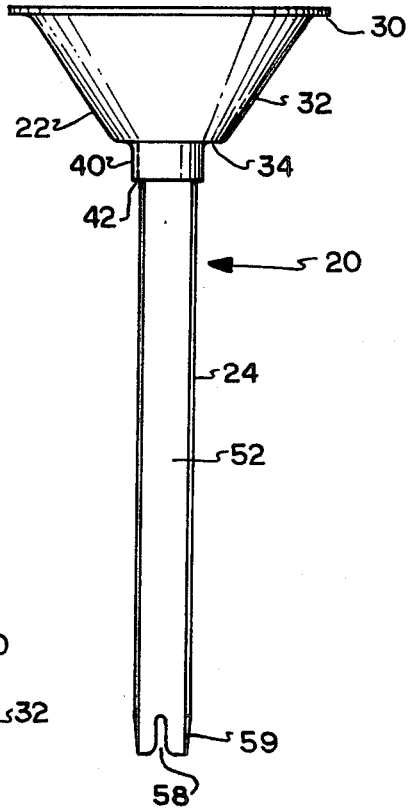
FIG. 1 is a front elevational view of the balloon holding device according to a preferred embodiment of this invention.

This invention is useful for securing either long-necked "Mylar" balloons or short-necked latex balloons to balloon sticks. This invention will be described in detail with reference to a preferred embodiment which is particularly useful for securing long-necked balloons to balloon sticks.

Balloon holders according to this invention are of one-piece construction and are preferably made of a rigid to semi-rigid plastic material, such as polypropylene, polystyrene, acrylonitrile-butadiene-styrene (ABS) or rigid polyvinyl chloride (PVC) by injection molding.

FIGS. 1 to 5 illustrate a balloon holder according to a preferred embodiment of this invention. Referring to FIGS. 1–5, 20 is a one-piece balloon holder comprising a cup 22 and a stem 24. Stem 24 is joined to the outside of cup 22 and extends longitudinally therefrom.

Cup 22 is adapted to receive a balloon 26 having a neck or tail 27, and stem 24 is adapted to be inserted into one end of a balloon stick 28, as will be described in greater detail with referecne to FIG. 10.

Cup 22 comprises, from top to bottom, a rim 30, a downwardly and inwardly sloping side wall 32, and a base 34. Rim 30 as shown is a circular (or annular) horizontal flange, but may be simply a lip. Side wall 32 as shown is frustoconical or funnel shaped. Other suitable side wall shapes include hemispherical and hemiellipsoidal. Base 34 as shown is a horizontal annular surface with a circular central opening. Base 34 is coaxial with rim 30 and side wall 32. Base 34 is not necessarily separate and distinct from side wall 32; for example, a hemispherical cup surface may embrace both. Usually rim 30, side wall 32 and base 34 are coaxial, however.

Cup 22 may have any one of a number of shapes, as long as it is open at the top. Generally the cup is symmetrical about a vertical axis; for example, it may be frustoconical (i.e. funnel shaped) as shown, hemispherical, hemiellipsoidal, or in the shape of a rectangular prism. The cup is preferably a surface of revolution, e.g. frustoconical or hemispherical, and the frustoconical shape shown is especially preferred. The rim generally lies in a plane perpendicular to the axis, and is preferably circular.

Cup 22 has an opening for insertion of the neck of a balloon. This opening is preferably a vertical slit 38 that extends radially the entire height of the cup, from rim 30 to base 34. This slit 38 terminates at its inner end in the vicinity of stem 24, preferably at the opening in cup base 34. Slit 38 is for insertion of a balloon neck 27 into holder 20. Slit 38 is symmetrical and comprises a first pair of tapered vertical surfaces **38*a*, a pair of parallel vertical surfaces 38*b*, and a second pair of tapered vertical surfaces 38*c*. The slit is wide at its outer end (at rim 30) to make it easy to insert a balloon neck 27, and is very narrow at its inner end. The second pair of tapered vertical surfaces 38*c* forms a locking finger which prevents balloon neck 27 from coming out of holder 20**.

A cylindrical collar 40 may be formed on the underside of cup base 34, between cup 22 and stem 24. Collar 40 is of slightly larger diameter than stem 24, forming a shoulder 42 which serves as a limit stop for the upper end of balloon stick 28. Collar 40 has a chamfered passageway 44 extending therethrough. Passageway 44 is in communication with the inside of cup 22. Collar 40 can be omitted, in which case the upper end of balloon stick will rest against cup base 34.

Figure 3:
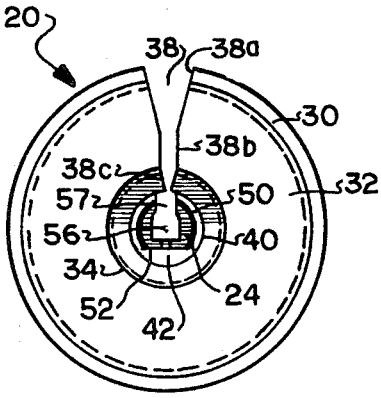
FIG. 3 is a bottom plan view looking up, of a balloon holding device according to a preferred embodiment of this invention.
Figures 5, 6, 7, 8, 9:
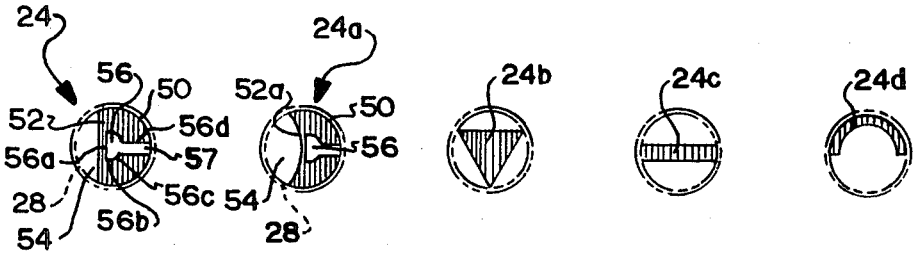
FIG. 5 is a horizontal sectional view, taken along line 5—5 of FIG. 4, showing the cross-sectional shape of the stem according to a preferred embodiment of the invention.
FIGS. 6, 7, 8 and 9 are horizontal sectional views showing the cross sectional shapes of stems according to further embodiments of this invention.

Stem 24 is joined to cup 22 at it axis through collar 40 and extends downwardly along the axis of cup 22. Stem 24 is of generally cylindrical cross section, as shown in FIGS. 3 and 5, and comprises a vertical cylindrical surfaces 50 and a flat surface 52. Cylindrical surface 50 is coaxial with cup 22, and has a diameter just slightly less than that of balloon stick 28. In effect, stem 24 has a cutout exterior portion, formed by flat surface 52, leaving a space 54 for a portion of balloon neck 27 between stem 24 and balloon stick 28, as best seen in FIG. 5. Stem 24 has a longitudinal channel 56 which is open at both end and which forms a cavity for a portion of the neck 27 of balloon 26. Channel 56 is open to the exterior of stem 24. Channel 56 is symmetrical but of irregular shape, comprising, from the inside out, a back wall **56*a* which is parallel to flat surface 52, a pair of parallel side walls 56*b*, and a pair of arcuate surfaces 56*c* having a common axis. A second pair of parallel walls 56*d*, which are closer together than the first pair 56*b* define an opening 57 for channel 56. Channel 56 is off center, i.e., the axis of arcuate surfaces 56*c* does not coincide with the axis of cup 22 and exterior surface 50, so that the wall thickness between surfaces 52 and 56*a* will be sufficient for structural strength. The width of surface 56*a* is preferably twice that of surfaces 56*b*. The opening 57 between surfaces 56*d*, which extends the entire height of collar 40 and stem 24, is in registry with slit 38 to permit insertion of a balloon neck 27. A balloon neck, once inserted, will stay in, because the space between theinner end of slit 38 is much narrower than the space between the surfaces 56*d*. A short notch or slit 58, at the bottom of stem 24 through the wall between flat surface 52 and channel 56, is provided for anchoring balloon tail 27. Notch 58 is rounded at the bottom. Notch 58 and flat surface 52 are diametrically opposite opening 57 and slit 38. The balloon neck extends downwardly through channel 56, is anchored in notch 58, and then extends upwardly in cavity 54. The bottom of stem 24 may have a tapered portion 59 to facilitate insertion of the stem 24** into a hollow stick.

The shape of stem 24 can be different from that shown in FIGS. 3 and 5, provided that the shape is such that the stem can be inserted into the end of a hollow balloon stick and provides space for a balloon neck between the stem and the balloon stick. Four alternative stem shapes are shown in FIGS. 6 to 9. Each of these figures is a horizontal section through the stem. FIG. 6 shows a stem **24*a* having a cylindrical surface 50 and a reverse curved cutout surface 52*a*. This surface, like its counterpart 52, forms a space for portion of a balloon neck. Surfaces 52 and 52*a* both intersect surface 50 and extend radially inwardly therefrom, thus forming a space for a balloon neck. Stem 24*a* has a channel 56 similar to that in FIGS. 3 and 5. FIG. 7 shows a triangular stem 24*b*. One side of the triangle is preferably perpendicular to the center plane of slit 38. (The center plane is a vertical plane which passes midway between each pair of opposed surface 38*a*, 38*b* and 38*c*). FIG. 8 shows a thin flat stem 24*c*, similar in shape to a popsicle stick, which is perpendicular to the center plane of slit 38. FIG. 9 shows a semicircular (or hemicylindrical) stem 24*d*. Balloon stick 28 is shown in dotted lines in each of thses figures. In each case the stem has a plurality of peripheral points which are at equal radii from the central axis of device 20. (The equal radii are just slightly less than the radius of balloon stick 28). Also, each stem has other points on its outer surface which are at less distance from the central axis than the peripheral points, so that there is space for a balloon neck as shown in FIGS. 6–9. Each of the stems 24*a*, 24*b*, and 24*d* may be provided with a notch 58** at its lower end for anchoring a balloon neck.

Preferred dimensions for a balloon holder 20 to be used for securing a balloon having a 4 inch neck are as shown in Table I below. In Table I, linear dimensions are in inches and angular measurements are in degrees. (1 inch=2.54 cm).

TABLE I

| Parameter | Dimension |
|---|---|
| Overall length | 2.438" |
| Length of stem 24 | 1.875" |
| Length of collar 40 | 0.125" |
| Height of cup 22 | 0.438" |
| Maximum diameter (diameter of rim 30) | 1.06" |
| Wall thickness of cup 22 | 0.025" |
| Angle of cup side wall 32[a] | 35° |
| Width of slit 38[b] | 0.060" |
| Minimum opening of slit 38 | 0.005" |
| Diameter of collar 40 | 0.235" |
| Outside diameter of stem 24 | 0.186" |
| Depth of notch | 0.125" |
| Length of tapered portion 59 | 0.125" |
| Angle of tapered portion 59[c] | 5° |

[a]Measured from vertical axis to side wall
[b]Distance between surfaces 38c
[c]Measured from vertical axis to tapered surface While the above dimensions are representative of a preferred embodiment, the dimensions may be varied as long as the holder is of sufficient length to completely conceal the balloon neck.

The balloon holder of the invention may also be used for short neck latex balloons. The overall length in that case will be much shorter than the length indicated in Table I above.

Figure 10:
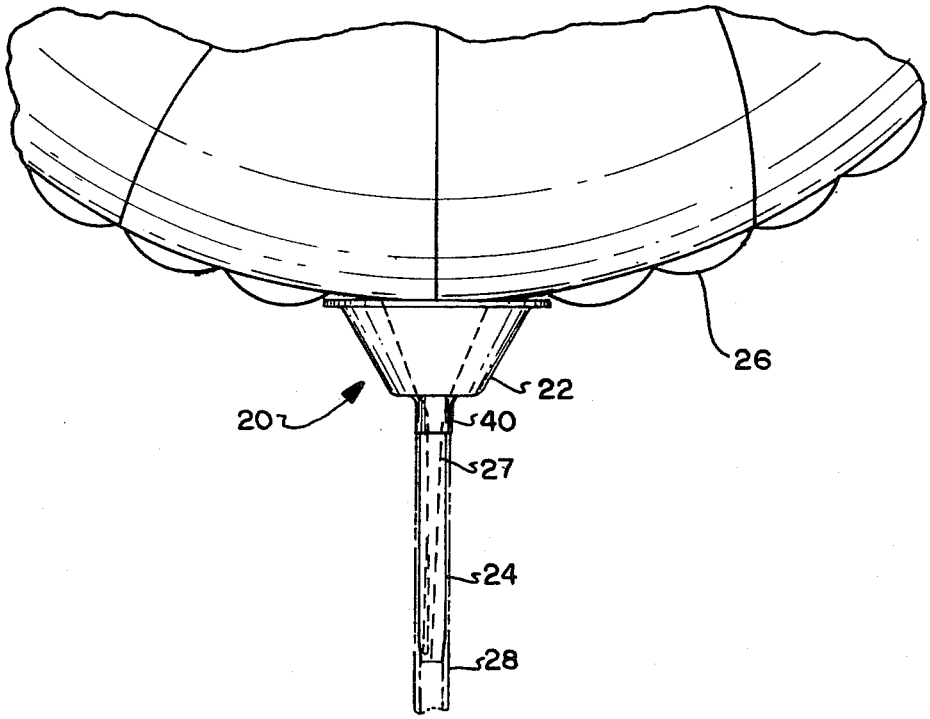
FIG. 10 is a side elevational view of a balloon holding device according to a preferred embodiment of this invention, with a balloon secured thereto and with all but the lower portion of the balloon broken away.

FIG. 10 shows a balloon holder 24 having a balloon 26 secured thereto, and with one end of a balloon stick 28 surrouding stem 24. All except the lower portion of balloon 26 has been broken away. Balloon 26 rests squarely on rim 30, instead of being off center as in prior art balloon holders. The neck 27 of balloon 26 extends downwardly virtually along the center axis of balloon holder 20, through passageway 44 and channel 56, to notch 58. Neck 27 engages notch 58, and the remainder of the neck extends upwardly through space 54, terminating short of shoulder 44. The length of stem 24 is at least one-half the length of balloon neck 27, so that the entire length of neck 27 will be contained in either passageway 44, channel 56 or space 54. The entire length of neck 27 is concealed, there is no visible tail as there is in the case of previously know balloon holders.

Balloon neck 27 can be inserted into balloon holder 20 simply by pulling the neck radially inwardly thorugh slit 38, i.e. from the outside to the inside of cup 22, until the greater part of the neck extends downwardly through channel 56. Neck 27 is inserted into notch 58, and the remainder of neck 27 is pulled upwardly alongside flat surface 52 with a slight tug. Notch 58 pinches the neck 27 and anchors the balloon 26 in place. Finally, the stem 24 and neck 27 are inserted into one end of a balloon stick 28.

The balloon holder of this invention offers several advantages over prior art balloon holders. First, the balloon is centered in the holder so that it does not flop around and is less prone to escape. Also, the appearance is more pleasing. Second, a balloon can be inserted rapidly into the holder of this invention; slit 38 permits quick insertion, and no time for winding the balloon neck around the cup will be required since the need to wind the neck to hide it and afix it more securely, will be completely eliminated. Third, the balloon neck is completely concealed, which is also pleasing in appearance. Fourth, the balloon is unlikely to escape; this is due partly to correct centering and partly to the presence of a notch for anchoring the balloon neck at the bottom of the stem. Other advantages will be apparent to those skilled in the art.

While in according with the patent statutes, a preferred embodiment and best mode has been presented, the scope of the invention is not limited thereto, but rather is measured by the scope of the attached claims.

What is claimed is:

1. A one-piece balloon holding device comprising a cup having a rim and a sidewall, and a longitudinally extending stem joined at one end to the outside of said cup at a locating remote from said rim;

said cup also having a longitudinally extending slit for insertion of the neck of the balloon;

said stem being adapted to be inserted into one end of a hollow balloon stick and being shaped so as to provide space for concealing said neck of said balloon inside said balloon stick when the stem is so inserted, said stem having means near the end remote from said cup for engaging said neck.

2. A balloon holding device according to claim 1 in which said cup is symmetrical about an axis and said rim lies in a plane perpendicular to said axis.

3. A balloon holding device according to claim 2 in which said cup is a surface of revolution.

4. A balloon holding device according to claim 3 in which said cup is funnel shaped.

5. A balloon holding device according to claim 2 in which said stem is joined to said cup at said axis and extends longitudinally in the direction of said axis.

6. A balloon holding device according to claim 1 including means forming a shoulder for the upper end of the balloon stick.

7. A one-piece balloon holding device according to claim 1 in which said stem is generally cylindrical and has a longitudinally extending cylindrical exterior surface, a second longitudinally extending exterior surface which intersects said cylindrical surface and extends radially inwardly therefrom to form a space for a portion of the neck of a balloon between said stem and said balloon stick, and a longitudinal channel which is open to the exterior and in registry with the slit in said cup for receiving another portion of the neck of said balloon.

8. A balloon holding device according to claim 1 in which said means for engaging said neck is a notch.

9. A balloon holding device according to claim 7 in which said second exterior surface is a flat surface.

10. A balloon holding device according to claim 7 including a collar between said cup and said stem, said collar providing a shoulder for the upper end of said balloon stick.

11. A balloon holding device according to claim 1 in which the exterior of said stem includes a first longitudinally extending surface which is in proximity with said balloon stick and a second longitudinally extending surface which intersects said first surface and extends radially inwardly therefrom when said stem is inserted into one end of said balloon stick, the space between said second surface and said balloon stick providing space for a portion of the neck of a balloon.

12. A balloon assembly comprising a balloon having a neck, a one-piece balloon holding device having a cup and a stem, and a hollow balloon stick, said stem being inserted into one end of said balloon stick;

said cup comprising a rim, a sidewall, and a longitudinally extending slit in said sidewall for insertion of said neck of said balloon;

said stem extending longitudinally from the outside of said cup at a location remote from said rim, the exterior surface of said stem being so shaped that at least one longitudinally extending portion of said suface is in proximity with said balloon stick and another longitudinally extending portion of said surface is disposed radially inwardly from the balloon stick, so as to provide space between said exterior surface and said balloon stick for a portion of said neck.

13. A balloon assembly according to claim 2 in which the exterior surface of said stem comprises a longitudinally extending cylindrical portion which is in proximity with said balloon stick and a second longitudinally extending portion which is disposed radially inwardly therefrom, thereby providing space for a portion of said neck between said stem and said stick, and a longitudinal channel which is open to the exterior and is registry with the slit in said cup for receiving another portion of the neck of said balloon.

* * * * *